US007032659B2

(12) United States Patent
Barnes et al.

(10) Patent No.: US 7,032,659 B2
(45) Date of Patent: Apr. 25, 2006

(54) INTEGRATED CONTROL SYSTEM FOR BEAM PUMP SYSTEMS

(75) Inventors: Mark Barnes, Houston, TX (US); John C. Bergmann, Alvin, TX (US); Ken G. Booth, Houston, TX (US); Alan Paine, La Verne, CA (US)

(73) Assignee: Weatherford/Lamb, Inc., Houston, TX (US)

( * ) Notice: Subject to any disclaimer, the term of this patent is extended or adjusted under 35 U.S.C. 154(b) by 95 days.

(21) Appl. No.: 10/350,157

(22) Filed: Jan. 23, 2003

(65) Prior Publication Data

US 2004/0144529 A1 Jul. 29, 2004

(51) Int. Cl.
*E21B 44/00* (2006.01)

(52) U.S. Cl. ..... 166/66; 166/53; 166/104; 417/18; 417/22

(58) Field of Classification Search ..... 166/369, 166/65.1, 66, 68, 72, 53, 104, 117, 162; 318/432, 318/433; 388/904; 417/18, 22
See application file for complete search history.

(56) References Cited

U.S. PATENT DOCUMENTS 3,936,231 A * 2/1976 Douglas ..... 417/12
3,965,736 A 6/1976 Welton
4,303,833 A 12/1981 Eckel et al.
4,487,061 A * 12/1984 McTamaney et al. .... 73/152.61
4,594,665 A * 6/1986 Chandra et al. ..... 702/6
5,284,422 A * 2/1994 Turner et al. ..... 417/18
5,291,777 A 3/1994 Chang et al.
5,362,206 A * 11/1994 Westerman et al. ..... 417/12
5,423,224 A 6/1995 Paine
5,464,058 A 11/1995 McCoy et al.
5,678,981 A 10/1997 Dunham
5,957,200 A * 9/1999 Majek et al. ..... 166/250.15
6,176,682 B1 1/2001 Mills
6,414,455 B1 * 7/2002 Watson ..... 318/432
6,679,332 B1 * 1/2004 Vinegar et al. ..... 166/373

OTHER PUBLICATIONS

PCT Invitation to Pay Fees, International Application No. PCT/US2004/001705, dated Jul. 14, 2004.
PCT Search Report, International Application No. PCT/US2004/001705, dated Nov. 5, 2004.

* cited by examiner

*Primary Examiner*—Frank S. Tsay
(74) *Attorney, Agent, or Firm*—Patterson & Sheridan

(57) ABSTRACT

The present invention generally provides apparatus and methods of operating a pumping system. The pump control apparatus includes a first sensor for measuring strain on a structure of the well pumping system and a second sensor for measuring a position of the structure. The apparatus also has a controller configured to control the well unit by receiving output signals from the first and second sensors and generating control signals according to a motor control sequence. This controller may be mounted to the structure of the pumping system to measure the strain experienced by the structure. The control signals may be transmitted to a motor control panel using a cable-less communications system. Preferably, the first sensor, the second sensor, and the controller are integrated into a single unit. In another embodiment, the pump control apparatus may be self-powered.

33 Claims, 7 Drawing Sheets

INTEGRATED CONTROL SYSTEM FOR BEAM PUMP SYSTEMS

BACKGROUND OF THE INVENTION

1. Field of the Invention

Aspects of the present invention generally relate to apparatus and methods of operating a rod-pumped well. Particularly, aspects of the present invention relate to an apparatus for controlling the operation of a rod-pumped well where the apparatus is mounted on a walking beam (or structural member) of a pumping system. More particularly, aspects of the present invention relates to an integrated control apparatus for operating a pumping system and measuring strain on the polished rod.

2. Description of the Related Art

Oil well rod pumping systems sometimes require a method to accurately determine the weight of the fluid in the production tubing during operation. This information is primarily required on wells that "pump-off", that is wells that do not produce enough fluid to permit them to be pumped continuously. When a well has been pumped off and there is insufficient fluid present in the wellbore at the pump intake, the pump is said to be undergoing "partial filling." Partial filling is an undesirable condition because it lessons the overall efficiency of the pumping system and may cause system failures over the operating life of the producing well.

Generally, partial filling causes fluid pounding, which can be damaging to various components of the pumping system. Fluid pound is typically caused by the pump not completely filling with fluid on the upstroke. As the downstroke begins, the entire fluid and rod string load moves down through a void until the plunger hits the fluid level in the pump barrel. When the traveling valve opens, the load is suddenly transferred to the tubing, thereby causing a sharp decrease in load. As a result, a shock wave transmits through the pumping system. The shock wave produced may damage the components of the pumping system.

To reduce the occurrence of partial filling, and to produce a well at or near maximum efficiency, a pump off control system is typically used on these wells. A pump-off control system generally includes a controller, a sensor for detecting the weight of the fluid in the production tubing during operation of the pumping system, and a device for measuring the position of the pumping system over each cycle of stroke. Examples of the load measurement devices employed for pump off control include use of load cell based technology installed on the pumping rod or mounted on the walking beam. Generally, these devices interface with the controller to produce information for well analysis. Analysis of this information will provide data relating to the amount of fluid in the wellbore and the accurate detection of fluid pound. The control system will shut the pump down when it determines that the wellbore is partially full or empty, thereby avoiding excess wear on the pumping equipment and also saving energy. The pump-off control system also protects the pumping system in the event of a critical malfunction in the sucker rod string or drive train. The system is turned off when such malfunctions are detected.

A device for measuring strain in the polished rod of a rod-pumped well unit is disclosed in U.S. Pat. No. 3,965,736 issued to Welten, et al. Welten discloses a system utilizing a strain-gage transducer welded to the top flange of the walking beam of an oil well pumping unit. The sensor is welded to the walking beam in order to achieve maximum sensitivity. A cable is used to connect the system to a controller.

More recently, a strain measuring device utilizing an integral clamp-on mechanism is attached to the load-bearing surface of the walking beam or any convenient location as disclosed in U.S. Pat. No. 5,423,224 issued to Paine, which is herein incorporated by reference. This device eliminates the requirement for welding of the load measurement device to the walking beam, thereby allowing for easier installation and maintenance of the device. However, this device, as with the Welten system, requires a cable to connect the transducer to the controller. In FIG. 1., a pump off control system, according to Paine, includes a strain measuring device 1 attached to the walking beam 2 of the pumping system 3. Information from the device 1 is relayed via cable 4 to the controller 6. After processing the information, the controller 6 sends signals to the motor control panel 5 to operate the pumping system 3.

Although the pump off control system shown in FIG. 1 is widely utilized, the pump off control system is difficult to install and maintain. For instance, to install the pump-off control system on an existing pumping system, a controller must be installed near the pumping unit, which, in most cases requires trenching, a pole to mount the controller, and cement to hold this structure in place. In addition, cables must be used to connect the various components of the system to relay information. To accommodate the landscape, the installation of the pump-off control system may be different each time, thereby requiring modification of the installation materials and procedure. Typical installation times per system may exceed several hours and require personnel of varied skill levels. Also, several key areas of this pump off control system require on-going maintenance, such as the cable interconnecting system. Further, the pump off control system may be susceptible to failure due to wear of the cables and the normal maintenance process for the pumping system.

There is a need, therefore, for a pump off control system that offers less complexity to install and that can be easily maintained. There is a further need for a pump-off control unit having an integrated controller and a pump rod load measuring device. Further still, there is a need for a pump-off control unit having an integrated controller and a pump rod load measuring device that transmits a control signal using a cable-less communications system.

SUMMARY OF THE INVENTION

The present invention generally provides apparatus and methods of controlling the operation of a well pumping system. The pump control apparatus includes a first sensor for measuring strain on a structure of the well pumping system and a second sensor for measuring a position of the structure. The apparatus also has a controller configured to control the well unit by receiving output signals from the first and second sensors and generating control signals according to a motor control sequence. The control signals may be transmitted to a motor control panel using a cable-less communications system.

In another aspect, the load measurement sensor, position measurement sensor, and the controller unit of the pump control apparatus may be integrated into a single unit. The pump control apparatus may further includes clamp members for selective attachment to a structure of the pumping system. In one embodiment, the pump control apparatus has a self-sustaining power supply.

In another aspect still, a method of operating a pumping system includes measuring a strain on a structure of the pumping system. The measured strain may used to generate a control signal to operate the pumping system. The control signal is transmitted to a motor control apparatus using a cable-less communications system. In one embodiment, the method may further include measuring a position of the structure of the pumping system. The measured position of the structure may be correlated with the measured strain to generate a control signal.

In yet another aspect, a method of operating a pumping system includes installing an integrated control unit on a structure of the pumping system. The integrated control unit is equipped with a controller and a first sensor for measuring strain. A strain measured on the structure is used to generate a control signal. The control signal may be transmitted to a motor control apparatus to operate the pumping system.

In yet another aspect, a cable-less communications system is mounted to a structure of a pumping system for transmitting control and diagnostic data.

In yet another aspect, an energy storage cell having a solar voltaic panel is mounted to a structure of a pumping system.

In yet another aspect, a pump control apparatus for operating a pumping system includes a sensor for measuring strain on a structure of a well unit, the sensor having a cable-less communications system. The pump control apparatus also has a controller configured to control the well unit by receiving an output signal from the sensor and generating one or more control signals according to a motor control sequence. In one embodiment, the output signal from the sensor is transmitted to the controller using a cable-less communications system.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
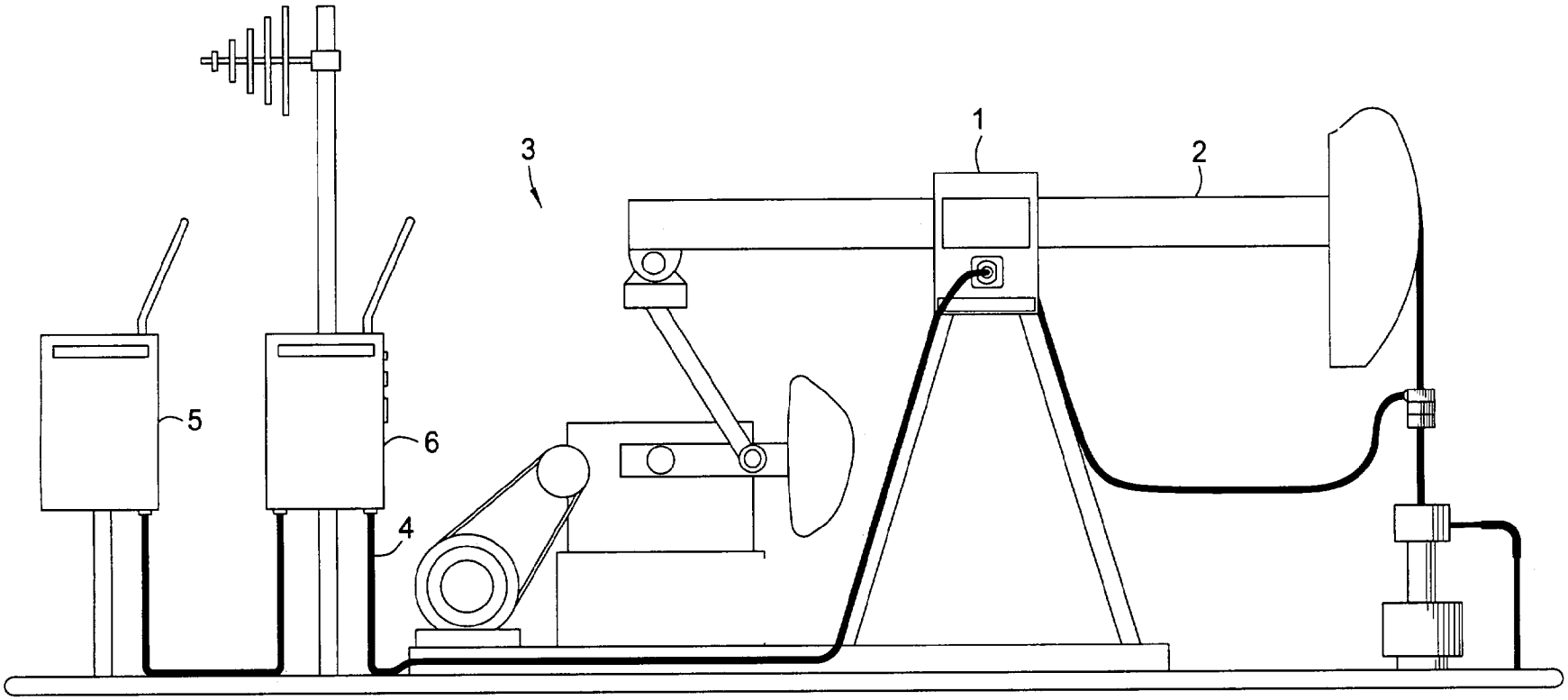
FIG. 1 ( PRIOR ART )
FIG. 1 shows a prior art pump off control unit.
Figure 2:
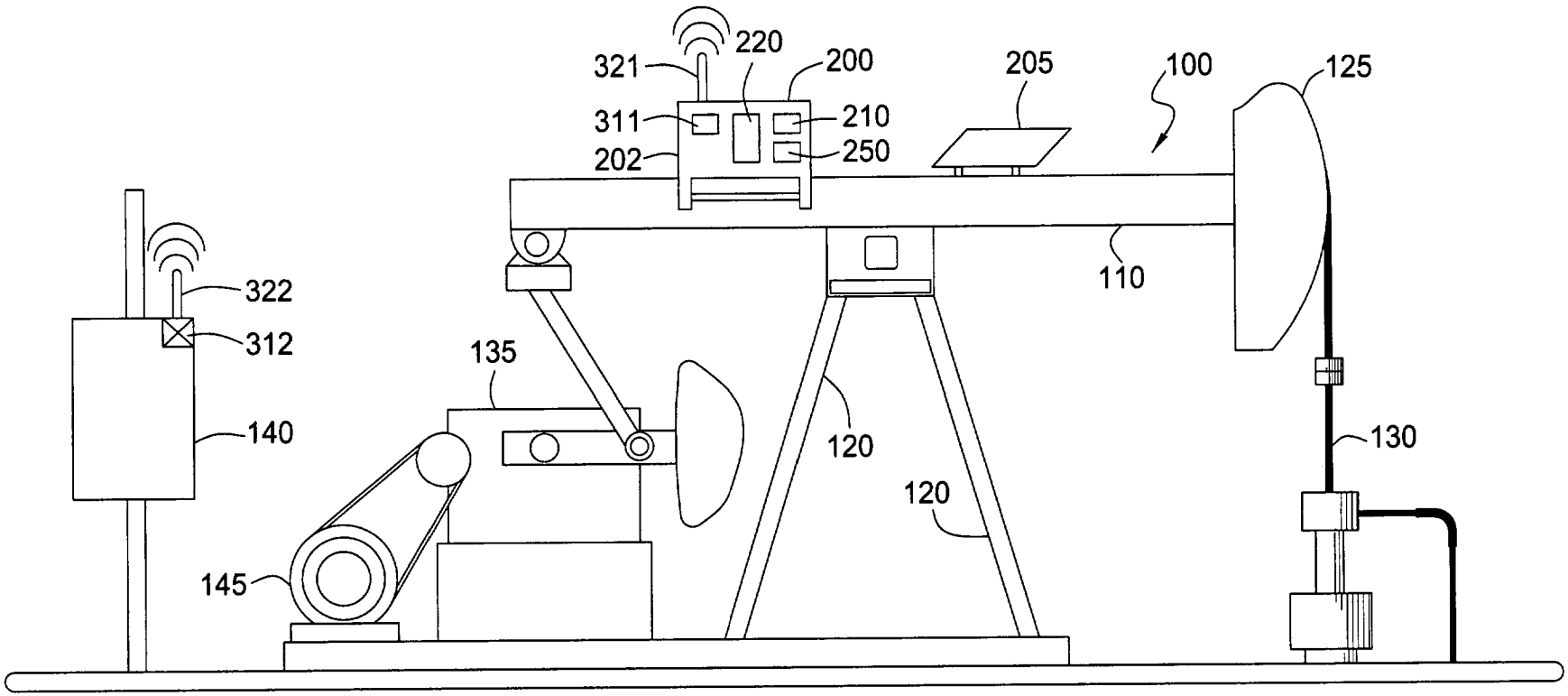
FIG. 2 shows one embodiment of a pump-off control system mounted on a pumping system according to aspects of the present invention.

FIG. 2 shows an embodiment of the pump-off control unit 200 of the present invention installed on a rod pumped well unit 100. The rod pumped well unit 100 is one that is commonly used to produce oil from a subterranean formation. The well unit 100 includes a walking beam 110 operatively connected to one or more posts 120. Attached to one end of the walking beam 110 is a horse head 125 operatively connected to a polished rod 130. A rod string (not shown) is connected below the polished rod 130 and is connected to a down-hole pump (not shown). The pumping system 135 is operated by a motor control panel 140 and powered by a motor 145.

In one aspect, the pump off control unit 200 is an integrated control unit capable of measuring the strain on the polished rod 130 and controlling the pumping system 135 based on the strain measured. The integrated control unit 200 may include a strain-measuring apparatus 210 integrated with electronic components for monitoring and controlling the pumping system 135. Preferably, the strain measuring apparatus 210 and the electronic components are at least partially housed together in an enclosure 202. The control unit 200 may further include means for attaching the control unit 200 to the well unit 100. The strain-measuring apparatus 210 may be selected from a variety of strain-measuring apparatus known to a person of ordinary skill in the art.

Figure 3:
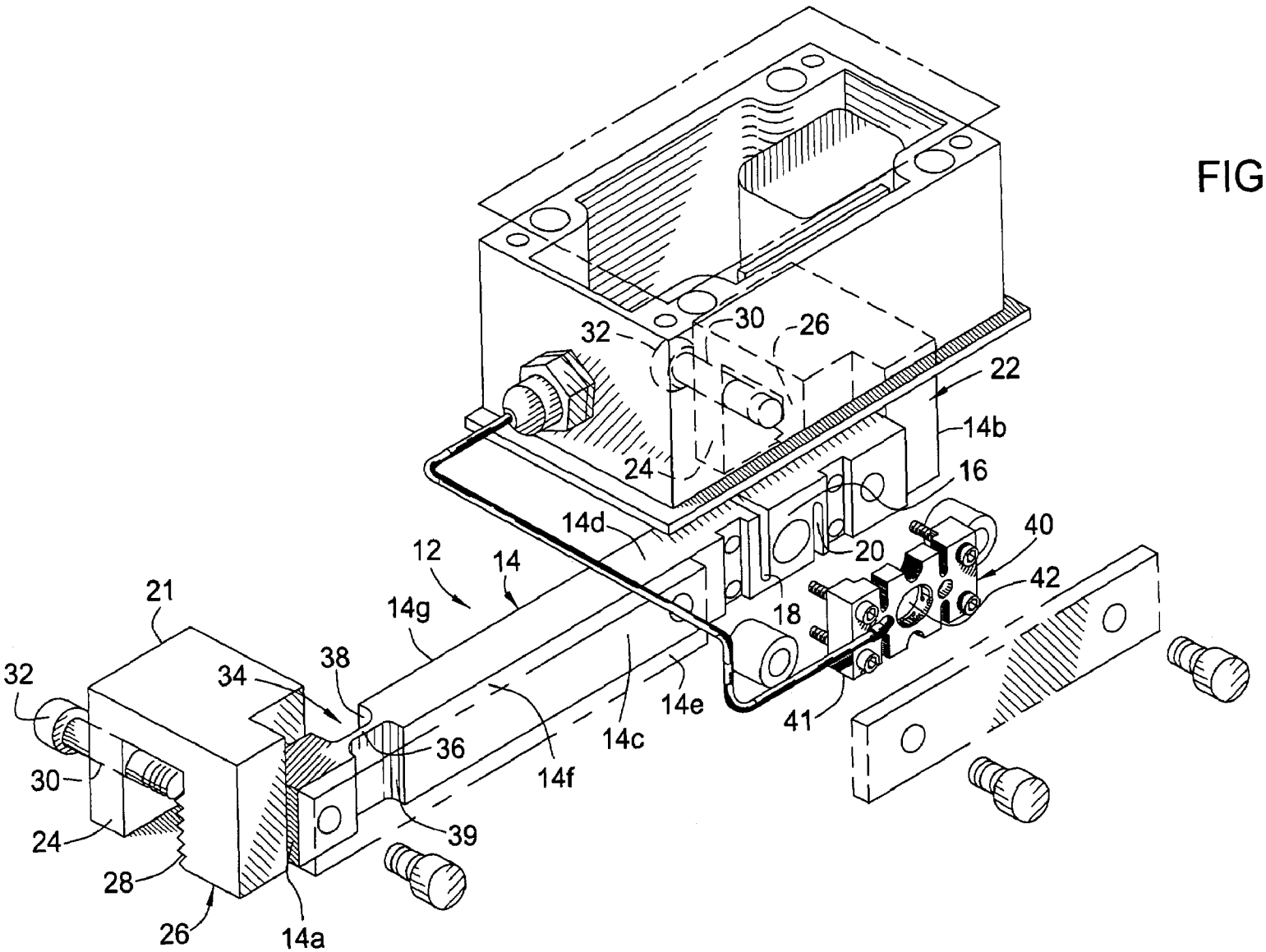
FIG. 3 is shows a strain-measuring apparatus usable with the aspects of the present invention.

In one embodiment, the strain-measuring apparatus 210 comprises two main components, one being a deflection collector base assembly generally designated in FIG. 3 by the numeral 12 and a sensor member 40 for sensing deflection in a flexure area 16 of a base member 14 which forms a part of the deflection collector base assembly 12. Base member 14 defines an elongated, bar-like member having first and second ends 14*a*, 14*b* and an intermediate portion 14*c*. Forming a part of intermediate portion 14*c* of the base member 14 is a first flexure area 16. The first flexure area 16 is located between two longitudinally, spaced-apart slots 18, 20. Slot 18 extends downwardly from the top surface 14*d* of the base member 14 while slot 20 extends upwardly from lower surface 14*e* of the base member 14.

Proximate the first and second ends 14*a*, 14*b* of the base member 14 are clamping means for clamping the deflection collector base 12 to a structural beam of the dynamic load-bearing structure such as the walking beam 110 of a rod pumped well unit 100. In one embodiment, the clamping means includes first and second clamping members 21, 22. The clamping members 21, 22 are interconnected with ends 14*a*, 14*b*, respectively. Each of the clamping members 21, 22 includes first and second spaced apart jaws 24, 26. Each jaw 24, 26 is provided with a multiplicity of gripping protuberances or teeth 28. Each of the jaws 24, 26, is further provided with a threaded aperture 30 which is adapted to threadably receive a threaded bolt 32 for urging the structural beam 110 into clamping engagement with teeth 28 of the jaws 24, 26.

As illustrated in FIG. 3, the intermediate portion 14*c* of the base member 14 is also provided with a second flexure area 34, which comprises a thin wall 36 that is disposed between first and second cutout portions 38, 39 formed in side walls 14*f*, 14*g* of the base member 14. The thin wall 36 preferably moves approximately 0.005 inches per pound across the wall 36. This permits bending of base member 14 in the second flexure area 34 instead of the first flexure area 16. This feature helps to prevent the sensor member 40 from mechanical overload and makes the first bending flexure area 16 primarily sensitive to tension and compression forces rather than to bending forces.

Figure 4:
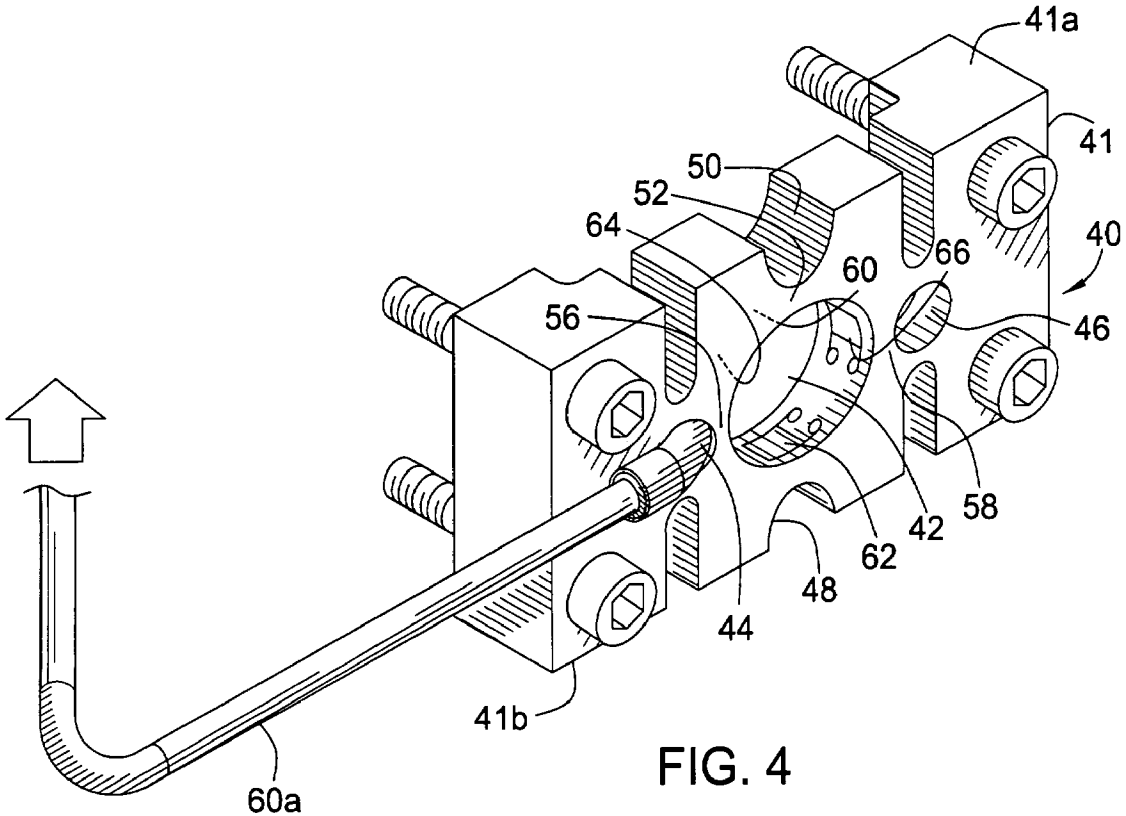
FIG. 4 is an exploded view of a portion of the strain-measuring apparatus shown in FIG. 3.

Turning now to FIG. 4, the sensing member 40, in one embodiment, may include a sensor base 41, which is preferably formed from a section of stainless steel plate. The sensor base 41 is provided with a plurality of cutout portions that define a plurality of thin wall areas on which foil strain gauges are affixed in a manner now to be described.

As shown in FIG. 4, the sensor base 41 is provided with a central aperture 42 and a pair of apertures 44, 46 that are located on either side of central aperture 42. Provided in the top and bottom walls 41*a*, 41*b* of the base 41 are semi-circular, cutout portions 48, 50. These cutout portions 48, 50 form in conjunction with the central aperture 42 first and second thin-wall portions 52, 54. Formed between apertures 44, 46 and central aperture 42 are third and fourth thin-wall portions 56, 58. The strain gauge sensors 60, 62, 64, 66, as will be described below, may be interconnected with the sensor base 41 in these thin-wall areas 52, 54, 56, 58.

Figure 5:
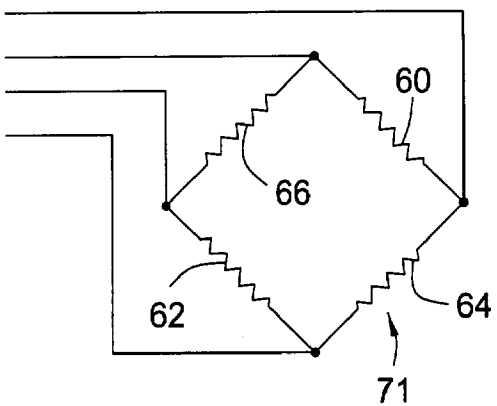
FIG. 5 is a diagrammatic view illustrating the manner of interconnection of the strain gauges.

In one embodiment, a first sensor 60 is affixed proximate the first thin-wall portion 52, and a second sensor 62 is affixed proximate the second thin-wall portion 54. Similarly, a third sensor 64 is affixed proximate the third thin-wall portion 56, and a fourth sensor 66 is affixed proximate the fourth thin-wall 58. The sensors 60, 62, 64, 66 are bonded to the respective thin-wall portions 52, 54, 56, 58 of the sensor base 41 with an appropriate adhesive, such as an epoxy glue, and are heat cured in position. Each of the sensors 60, 62, 64, 66 may include a foil strain gauge of a character readily commercially available and known to a person of ordinary skill in the art. In one example, the foil strain gauges may be made of platinum, tungsten/nickel, or chromium, as is readily commercially available from Muse Measurements of San Dimas, Calif. Preferably, the sensors 60, 62, 64, 68 are wired in a typical Wheatstone bridge configuration 71 as shown in FIG. 5. Thin-wall portions 52, 54, 56, 58 respond to tension and compression loading across their length. The load varies depending upon the deflection transmitted from the structure 110 through base member 14 to the sensors 60, 62, 64, 66. The range of force needed to deflect the sensor for a typical application is between zero and approximately fifty (50) pounds. Signal output and deflection is approximately 0.00025 inches of deflection equaling 0.10 MV/V. It is to be understood that for certain applications, semi-conductor gauges may be used in place of the foil strain gauges. Additionally, the sensor itself may be affixed by any suitable means such as welding or by the use of mechanical fasteners if clamping is for any reason undesirable.

The control unit 200 may include a position measurement device 250 for measuring the position of the walking beam 110 relative to the top or bottom of the stroke, as schematically shown in FIG. 2. In this respect, the output from the strain measuring apparatus 210 may be correlated to the position of the polished rod 130 and used to determine strain experienced by the polished rod 130 during the stroke cycle. In one embodiment, the position measurement device 250 is a dual position sensor, which is a dual axis accelerator based position sensor. The dual position sensor combines a means of producing a continuous position measurement and a discrete switch output, which closes and opens at preset positions of the polished rod 130, into one device. The position measurement device 250 also provides means of filtering data in order to increase accuracy of the position measurement, thereby contributing to the overall accuracy of the control unit 200.

Figure 6:
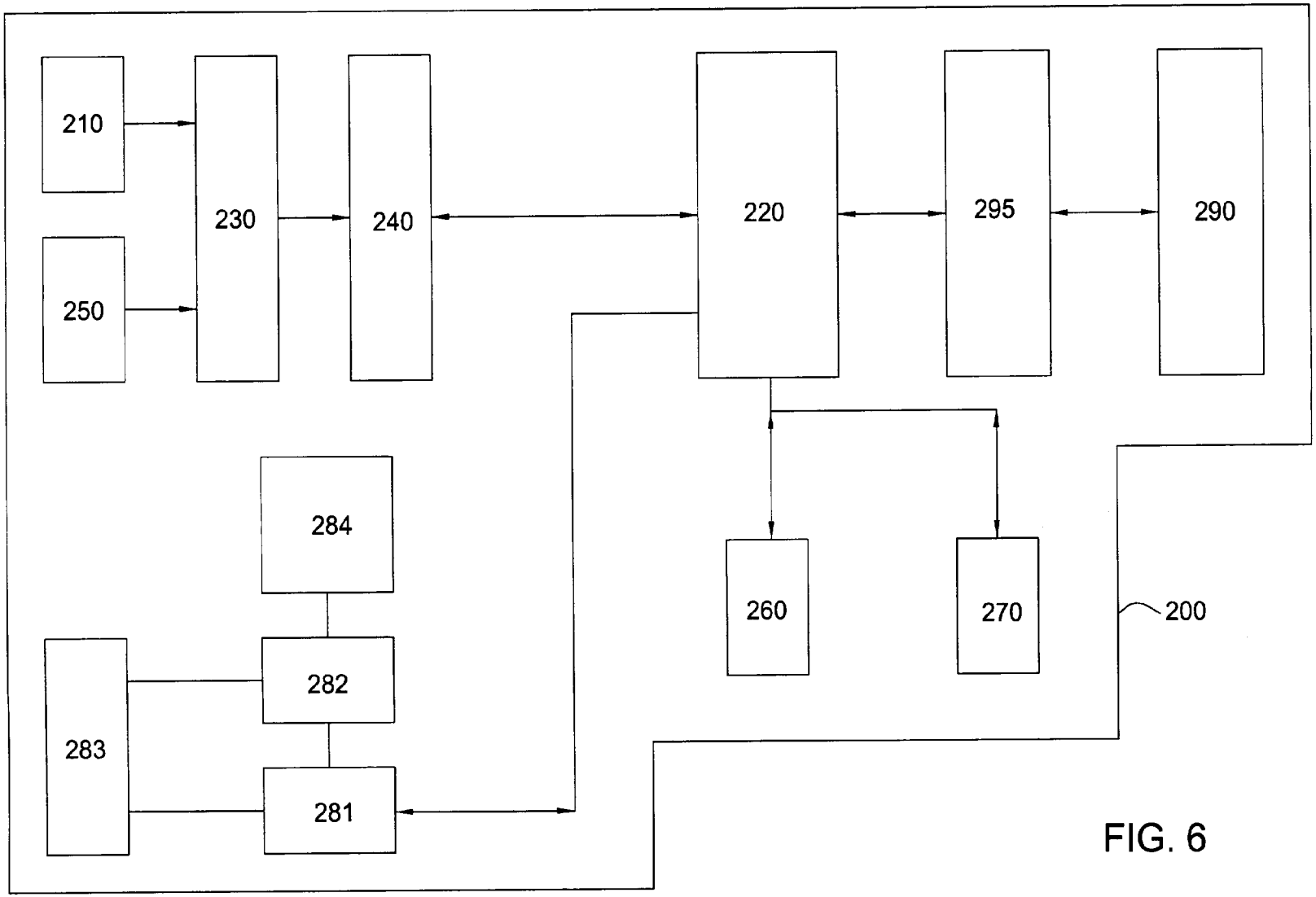
FIG. 6 is a block diagram of the various components of an embodiment of the control unit of the present invention.

Referring to FIG. 6, outputs from the strain measuring apparatus 210 and the position measurement device 250 are ultimately processed by a controller 220 programmed to perform a motor control sequence. Initially, the outputs are transmitted to a signal conditioning circuit 230 to condition the signals into a signal suitable for processing by an analog-to-digital (A/D) converter 240. For example, low-level signal from the sensors 210, 250 may be conditioned into a higher-level analog signal before being transmitted to the A/D converter 240. Thereafter, the converted signals are transmitted to the controller 220.

The controller 220 may include internal or external memory, which may be any suitable type. For example, the memory may be a battery-backed volatile memory or a non-volatile memory, such as a one-time programmable memory or a flash memory. Further, the memory may be any combination of suitable external and internal memories.

In one embodiment, the control unit 200 may include a program memory 260 and a data memory 270. The program memory 260 may store a motor control sequence and the data memory 270 may store a data log. The data log may store data read from the strain sensors 210 and the position sensor 250. The motor control sequence may be stored in any data format suitable for execution by the controller 220. For example, the motor control sequence may be stored as executable program instructions. Although FIG. 6 shows these components as being separate, it must be noted that any or all of these components may be integrated or embedded into one component as is known to a person of ordinary skill in the art.

The control unit 200 may also include a power system for operating the control unit 200 itself. The power system may include a power controller 281, power supply 282, and a power transducer 283, as is known to a person of ordinary skill in the art. Power may be supplied through a battery 284 or a battery charger. In one embodiment, the control unit 200 has a battery charger 205 for collecting power from a solar panel attached to the walking beam 110 as illustrated in FIG. 2. For example, the battery charger 205 may comprise an energy storage cell having a solar voltaic panel and any other energy cell known to a person of ordinary skill in the art.

In another aspect, the control unit 200 may further include a serial data communications port 290 and any suitable communications subsystem and transducer 295 for communicating with other control elements. In one embodiment as shown in FIG. 2, a radio unit 311 having an antenna 321 is provided for remote communication with a control element such as the motor control panel 140. In another embodiment, the antenna 321 may be embedded into the controller 220 when a non-conductive enclosure 202, such as a fiberglass enclosure, is used. It is contemplated that these components include any suitable communication ports, antenna, and radio unit known to a person of ordinary skill in the art.

Outputs generated from the controller 220 in accordance with the motor control sequence are transmitted to the motor control panel 140, using a cable-less communications system, for controlling the operations of the pump unit 135. In one embodiment, the motor control panel 140 may include a radio unit 312 having an antenna 322 for receiving signals from the radio unit 311 of the control unit 200. Preferably, the radio units 311, 312 are configured to operate with spread spectrum technology. In another embodiment, the signal from the control unit 200 may be transmitted to the motor control panel 140 using a cable. The motor control panel 140 may be equipped with one or more motor control relay assemblies to facilitate transmission of the control signals to operate the pumping system 135. By integrating the strain sensors 210 and the position device 250 with the controller 220 for control and optimization of the pump system 135, aspects of the present invention provide a control unit 200 that significantly eliminates the cabling between the major control elements, thereby minimizing the maintenance requirements of the control unit 200 and vastly simplifying the installation of the control system.

Figure 7:
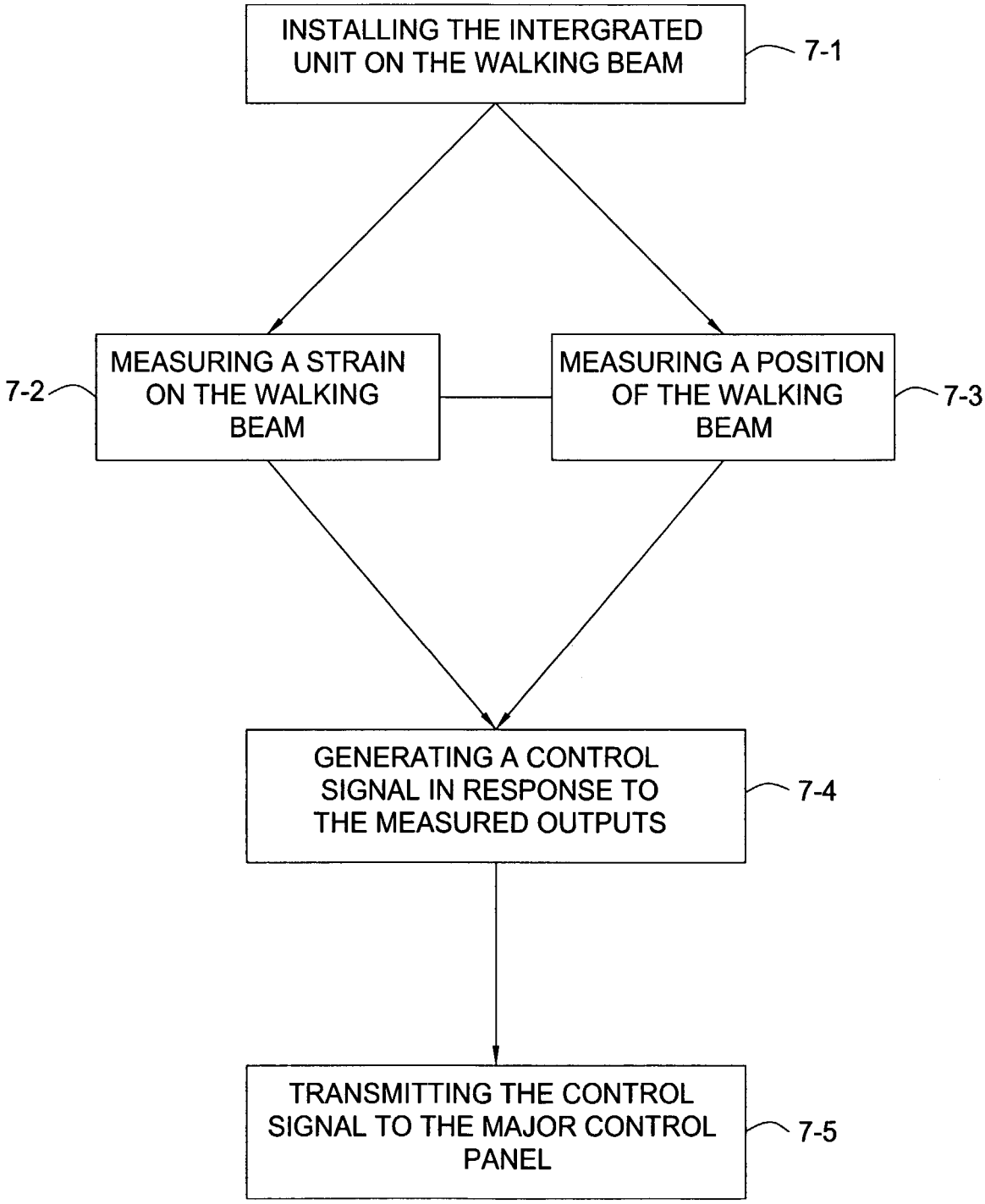
FIG. 7 is a flow chart of a method of operating of the pump off control system according to aspects of the present invention.

FIG. 7 is a flow diagram illustrating exemplary operations of a method according to an embodiment of the present invention. FIG. 7 may be described with reference to the exemplary embodiment of FIG. 6. However, it will be appreciated that the exemplary operations of FIG. 7 may be performed by embodiments other than that illustrated in FIG. 6. Similarly, the exemplary embodiment of FIG. 6 is capable of performing operations other than those illustrated in FIG. 7.

The method begins with installing the integrated control unit on the walking beam of the rod pumped well unit, as indicated by step 7-1. During operations, strain on the walking beam is measured using the strain-measuring apparatus, step 7-2. The strain is measured with respect to the position of the walking beam as determined by the position measurement device, step 7-3. The two outputs are transmitted to the controller, which generates one or more control signals in response to the measured outputs, step 7-4. The control signals are then transmitted to the motor control panel for controlling the well pumping system 7-5. Preferably, the control signals are transmitted using a cable-less communications system equipped with an antenna. In this manner, the pumping system may be controlled without the need of cables to relay signals between the control unit and the motor control panel. Further, integration of the components of the control system streamlines the installation procedure by eliminating the separate installation of the control system components as required by a conventional method.

Figure 8:
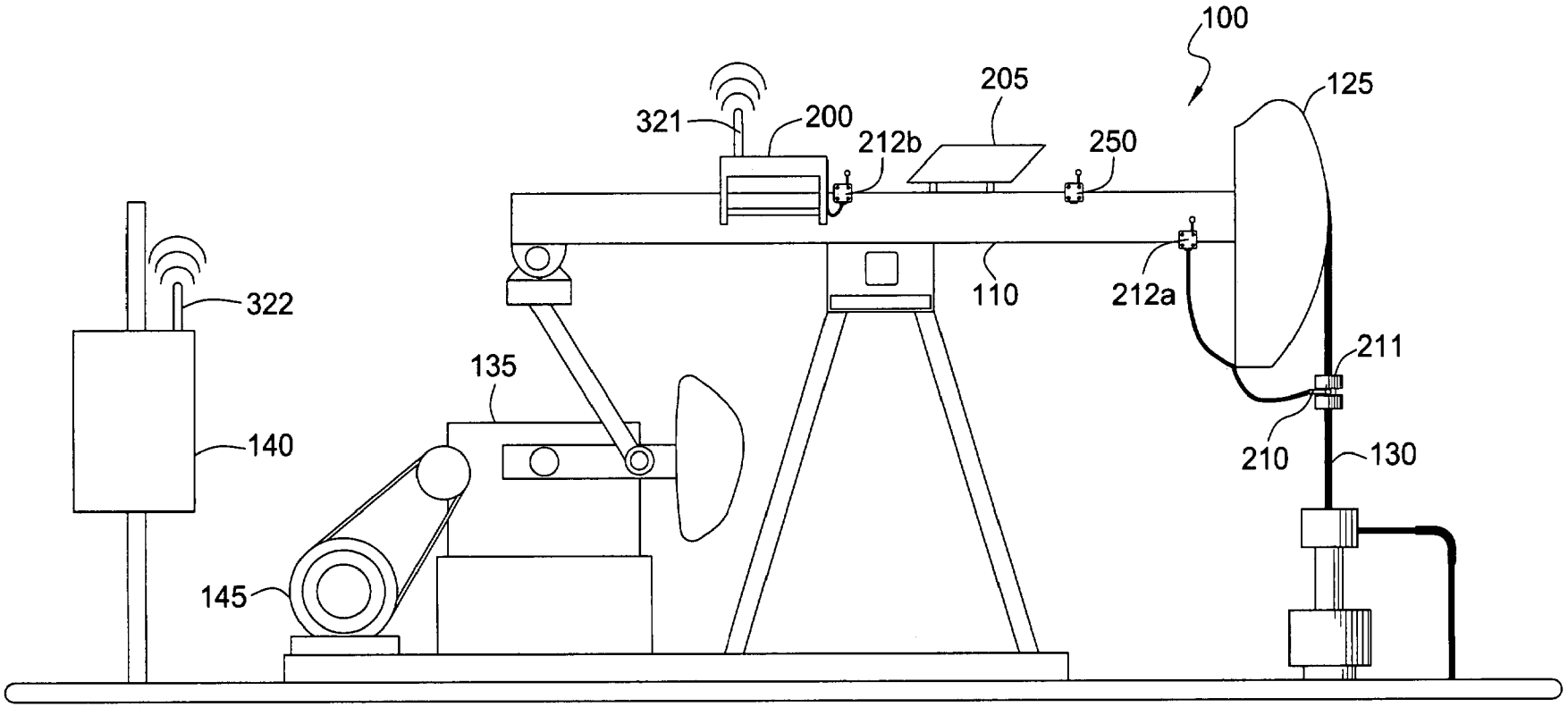
FIG. 8 illustrates another embodiment of a pump-off control system mounted on a pumping system according to aspects of the present invention.

In another aspect, the strain measuring apparatus 210 may be separate from the control unit 200 as illustrated in FIG. 8. In this embodiment, the strain measuring apparatus 210 may include strain gauges 211 and a cable-less communication unit 212*a* for communicating with the control unit 200. The strain gauges 211 may be attached to the polishing rod 130 to measure the strain experienced by the polishing rod 130. The measured strain may be transmitted to the communication unit 212*a* to relay the information to the control unit 200 for processing. The control unit 200 may include a receiver unit 212*b* to receive the information from the strain measuring apparatus 210. Accordingly, it is not necessary to attach the control unit 200 to the walking beam 110. Instead, the control unit 200 may be attached to or integrated with the motor control panel 140 and still receive outputs from the strain measuring apparatus 210. It must be noted that the cable-less communication units 212*a*, 212*b* may include any suitable communication ports, antenna, and radio unit, as is known to a person of ordinary skill in the art.

In another aspect still, the position measuring device 250 may also be separate from the control unit 200. As shown in FIG. 8, the position measuring device 250 is attached to the walking beam 110 and may include position sensors and a cable-less communication unit. The position sensors measure the position of the walking beam 110 and relay the information to the control unit 200 via the cable-less communication unit.

While the foregoing is directed to embodiments of the present invention, other and further embodiments of the invention may be devised without departing from the basic scope thereof, and the scope thereof is determined by the claims that follow.

We claim:

1. A pump control apparatus for operating a pumping system, comprising:

a first sensor for measuring strain on a structure of the pumping system;

a second sensor for measuring a position of the structure;

a cable-less communications system;

a controller configured to control the pumping system by receiving one or more output signals from the first and second sensors and generating one or more control signals according to a motor control sequence; and a housing for supporting the first and second sensors, the controller, and a cable-less communications system; and attachment members for attaching the housing to the structure.

2. The apparatus of claim 1, wherein the first sensor is selectively attached to the structure.

3. The apparatus of claim 2, wherein the structure comprises a walking beam of the pumping system.

4. The apparatus of claim 1, wherein the one or more control signals are transmitted to one or more motor control apparatus.

5. The apparatus of claim 4, wherein the one or more control signals are transmitted using the cable-less communications system.

6. The apparatus of claim 1, wherein the cable-less communications system is selected from the group consisting of a radio unit, an antenna, and combinations thereof.

7. The apparatus of claim 1, wherein the cable-less communications system uses spread spectrum technology.

8. The apparatus of claim 1, further comprising an energy storage cell to supply power.

9. The apparatus of claim 8, wherein the energy storage cell comprises a solar voltaic panel.

10. A method of operating a pumping system, comprising:

attaching a control unit to a structure of the pumping system;

measuring a strain on the structure;

generating one or more control signals in response to the measured strain; and transmitting the one or more control signals from the control unit to a motor control apparatus using a cable-less communications system.

11. The method of claim 10, further comprising measuring a position of the structure of the pumping system.

12. The method of claim 11, wherein the one or more control signals are generated in response to the measured strain and the measured position.

13. The method of claim 12, further comprising correlating the measured strain to the measured position.

14. The method of claim 10, further comprising transmitting the measured strain to a controller configured to control the pumping system using a second cable-less communications system.

15. The method of claim 10, further comprising operating a motor based on the one or more control signals received by the motor control apparatus.

16. A pump control apparatus for operating a pumping system, comprising:

a control unit having:

a first sensor for measuring strain on a structure of the pumping system;

a second sensor for measuring a position of the structure; and a body, wherein the first sensor and the second sensor are supported on the body; and an attachment member for attaching the control unit to the structure;

a motor control unit for operating the pumping system; and a cable-less communication system for transmitting a signal from the control unit to the motor control unit.

17. The pump control apparatus of claim 16, further comprising a controller configured to control the pumping system by receiving an output signal from at least one of the sensors and generating one or more control signals according to a motor control sequence.

18. The pump control apparatus of claim 16, wherein the structure is a walking beam or a polished rod.

19. The pump control apparatus of claim 16, further comprising an energy storage cell.

20. A method of operating a pumping system, comprising:

installing an integrated control unit on a structure of the pumping system, the integrated control unit having:

a strain measuring sensor;

a position measuring sensor; and a support structure for installing the control unit on the structure;

measuring a strain on the structure;

measuring a position of the structure;

generating one or more control signals in response to the measured strain; and transmitting the one or more control signals to a motor control unit.

21. The method of claim 20, wherein the one or more control signals are generated in response to the measured strain and the measured position.

22. The method of claim 20, further comprising correlating the measured strain and the measured position.

23. The method of claim 20, wherein the one or more control signals is transmitted using a cable-less communications system.

24. A pump control apparatus for controlling a pumping system, comprising:

a control unit, having:

a body attachable to a structure of the pumping system; and a strain sensor connected to the body;

a motor control unit for operating the pumping system; and a cable-less communication system for transmitting a signal from the control unit to the motor control unit.

25. The pumping system of claim 24, further comprising a position sensor connected to the body.

26. The pumping system of claim 24, further comprising a controller for generating a control signal in response to the measured strain.

27. The pumping system of claim 26, wherein the controller is connected to the body.

28. The pumping system of claim 24, wherein the structure is a walking beam or a polished rod.

29. A pump control apparatus for controlling a pumping system, comprising:

a control unit, having:

a body attachable to a structure of the pumping system;

a strain sensor connected to the body; and a controller for generating a control signal in response to the measured strain; and a motor control unit for operating the pumping system based on the control signal.

30. The pumping system of claim 29, further comprising a position sensor connected to the body.

31. The pumping system of claim 29, wherein the structure is a walking beam or a polished rod.

32. The pumping system of claim 29, further comprising a cable for transmitting a control signal to the motor control unit.

33. A pump control apparatus for operating a pumping system, comprising:

a first sensor for measuring strain on a structure of the pumping system;

a second sensor for measuring a position of the structure;

a cable-less communications system; and a controller configured to control the pumping system by receiving one or more output signals from the first and second sensors and generating one or more control signals according to a motor control sequence, wherein the first sensor is integrated with the controller and at least partially housed together in an enclosure.

* * * * *

UNITED STATES PATENT AND TRADEMARK OFFICE

CERTIFICATE OF CORRECTION

PATENT NO. : 7,032,659 B2
APPLICATION NO. : 10/350157
DATED : April 25, 2006
INVENTOR(S) : Mark Barnes et al.

It is certified that error appears in the above-identified patent and that said Letters Patent is hereby corrected as shown below:

<u>In the Claims section</u>:

In column 8, Claim 1, line 7, before "cable-less", please delete "a" and insert --the--.

In column 10, Claim 25, line 1, please delete "pumping system" and insert --pump control apparatus--.

In column 10, Claim 26, line 3, please delete "pumping system" and insert --pump control apparatus--.

In column 10, Claim 27, line 6, please delete "pumping system" and insert --pump control apparatus--.

In column 10, Claim 28, line 8, please delete "pumping system" and insert --pump control apparatus--.

In column 10, Claim 30, line 19, please delete "pumping system" and insert --pump control apparatus--.

In column 10, Claim 31, line 21, please delete "pumping system" and insert --pump control apparatus--.

In column 10, Claim 32, line 23, please delete "pumping system" and insert --pump control apparatus--.

Signed and Sealed this

Thirtieth Day of January, 2007

JON W. DUDAS
*Director of the United States Patent and Trademark Office*

UNITED STATES PATENT AND TRADEMARK OFFICE
Certificate

Patent No. 7,032,659 B2 Patented: April 25, 2006

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Mark Barnes, Houston, TX (US); John C. Bergmann, Alvin, TX (US); Ken G. Booth, Houston, TX (US); Alan Paine, La Verne, CA (US); Mike Guilotte, Sierra Vista, CA (US); and Gregg Hurst, Humble, TX (US).

Signed and Sealed this Third Day of April 2007.

DAVID J. BAGNELL
*Supervisory Patent Examiner*
Art Unit 3672